US008342808B2

(12) United States Patent
Ota et al.

(10) Patent No.: US 8,342,808 B2
(45) Date of Patent: Jan. 1, 2013

(54) COOLING FAN

(75) Inventors: Hidetake Ota, Kiryu (JP); Hirohiko Maekawa, Kiryu (JP); Yuichi Katayama, Kiryu (JP)

(73) Assignee: Mitsuba Corporation, Gunma (JP)

( * ) Notice: Subject to any disclaimer, the term of this patent is extended or adjusted under 35 U.S.C. 154(b) by 403 days.

(21) Appl. No.: 12/312,695

(22) PCT Filed: Dec. 5, 2007

(86) PCT No.: PCT/JP2007/073470

§ 371 (c)(1),
(2), (4) Date: May 20, 2009

(87) PCT Pub. No.: WO2008/072516

PCT Pub. Date: Jun. 19, 2008

(65) Prior Publication Data

US 2010/0068060 A1 Mar. 18, 2010

(30) Foreign Application Priority Data

Dec. 11, 2006 (JP) ..... 2006-333037

(51) Int. Cl.

| | |
|---|---|
| ***A47C 7/74*** | (2006.01) |
| ***A47C 21/04*** | (2006.01) |
| ***B63H 1/00*** | (2006.01) |
| ***B63H 3/00*** | (2006.01) |
| ***B63H 5/00*** | (2006.01) |
| ***B64C 11/00*** | (2006.01) |
| ***B64C 27/00*** | (2006.01) |

(52) U.S. Cl. ..... 416/169 A; 416/179; 416/192; 416/193 R

(58) Field of Classification Search ..... 416/169 A, 416/179, 192, 193 R
See application file for complete search history.

(56) References Cited

U.S. PATENT DOCUMENTS

| | | | | |
|---|---|---|---|---|
| 5,577,888 | A | 11/1996 | Capdevila et al. | |
| 6,514,052 | B2 * | 2/2003 | Bostwick | 417/366 |
| 7,484,925 | B2 * | 2/2009 | Carlson et al. | 415/79 |
| 2002/0141871 | A1 * | 10/2002 | Medamaranahally | 416/193 R |

FOREIGN PATENT DOCUMENTS

| | | |
|---|---|---|
| JP | 54-35408 | 3/1979 |
| JP | 58-113899 | 8/1983 |
| JP | 62-204000 | 12/1987 |
| JP | 63-48996 | 4/1988 |

(Continued)

OTHER PUBLICATIONS

State Intellectual Property Office, P. R. China, First Office Action, Jun. 2, 2010, from related Chinese patent application No. 200780045260.9 (with English translation).
State Intellectual Property Office, P. R. China, Second Office Action, Dec. 24, 2010, from related Chinese patent application No. 200780045260.9 (with English translation).

(Continued)

*Primary Examiner* — Phat X Cao
(74) *Attorney, Agent, or Firm* — Kenyon & Kenyon LLP

(57) ABSTRACT

A cooling fan of the present invention includes: a bottomed cylindrical boss portion; and a plurality of blades provided on an outer circumferential surface of the boss portion, the blades radiating in a radial direction, in which a ring member for connecting the blades with each other is provided on a side radially inner from tips of the blades. According to the present invention, it is possible to provide a cooling fan capable of preventing the worsening of the noise characteristic and also of enhancing the versatility even if the blades are made thinner.

6 Claims, 4 Drawing Sheets

FOREIGN PATENT DOCUMENTS

| | | |
|---|---|---|
| JP | 63-48997 | 4/1988 |
| JP | A-04-339200 | 11/1992 |
| JP | A-06-229397 | 8/1994 |
| JP | A-11-93897 | 4/1999 |
| JP | A-2000-110789 | 4/2000 |
| JP | 2004-218513 | 8/2004 |

OTHER PUBLICATIONS

Office Action issued on Oct. 23, 2012 in corresponding JP Patent Application No. 2008-549256.

* cited by examiner

COOLING FAN

TECHNICAL FIELD

The present invention relates to a cooling fan for use in an automobile radiator and the like.

Priority is claimed on Japanese Patent Application No. 2006-333037 filed on Dec. 11, 2006, the contents of which are incorporated herein by reference.

BACKGROUND ART

Conventionally, cooling fans for use in an automobile radiator and the like are often axial fans and diagonal fans. The cooling fans of these types are made of: a bottomed cylindrical boss portion that is rotated by a drive source such as an engine or an electric motor; and a plurality of blades provided on an outer circumferential surface of the boss portion, the blades radiating in a radial direction.

By the way, there is known a cooling fan in which the tips of the blades are connected with each other by means of an annular ring member, to thereby improve the strength of the blades. In such a cooling fan with a ring member provided on the tips of the blades, the blades become heavy. Therefore, the blades are made thinner, to thereby make the blades lighter (for example, see Patent Document 1).

Patent Document 1: Japanese Unexamined Patent Publication, First Publication No. 2004-218513

However, in the aforementioned conventional technique, since the blades are made thinner, when the cooling fan is rotated, the thinned blades flap. This poses a problem of worsening the noise characteristic.

In addition, with a ring member provided on the tips of the blades, the cooling fan has a large diameter, which results in the requirement of a dedicated shroud. This poses a problem in which the versatility of the cooling fan is decreased.

DISCLOSURE OF INVENTION

Therefore, the present invention has been achieved in view of the aforementioned circumstances, and has an object to provide a cooling fan capable of preventing the worsening of the noise characteristic and also of enhancing the versatility even if the blades are made thinner.

A cooling fan according to the present invention includes: a bottomed cylindrical boss portion; and a plurality of blades provided on an outer circumferential surface of the boss portion, the blades radiating in a radial direction, in which a ring member for connecting the blades with each other is provided on a side radially inner from tips of the blades.

In the cooling fan of the present invention, it is desirable that the ring member be provided on a side outer from radial centers of the blades.

In the cooling fan of the present invention, it is desirable that a thickness of the blade positioned radially inner from the ring member be set different from a thickness of the blade positioned radially outer from the ring member.

In the cooling fan of the present invention, it is desirable that the thickness of the blade positioned radially inner from the ring member be set thinner than the thickness of the blade positioned radially outer from the ring member.

According to the present invention, the ring member is provided on the side radially inner from the blade tips. Therefore, it is possible to prevent an increase in diameter of the cooling fan. As a result, it is possible to enhance the versatility of the cooling fan while improving the blade strength.

Furthermore, it is possible to make the diameter of the ring member smaller compared with the case where the ring member is provided on the tips of the blades. As a result, it is possible to reduce manufacturing costs.

In addition, it is possible to make the distance from the base of the blade to the portion on which the ring member is provided shorter compared with the case where the ring member is provided on the blade tips. Consequently, even if the blade is made thinner, it is possible to secure the strength of the blade, and to suppress the flapping of the blade when the cooling fan is rotated. Therefore, it is possible to prevent the worsening of the noise characteristic while reducing the weight of the blade.

Furthermore, according to the present embodiment, the side of the blade radially inner from the ring member is supported by the boss portion and the ring member. On the other hand, the side of the blade radially outer from the ring member is supported only by the ring member. Therefore, the blade on the side radially inner from the ring member is stronger than the blade on the side radially outer from the ring member.

Consequently, it is possible to set the thickness of the blade on the side radially inner from the ring member thinner than that of the blade on the. side radially outer from the ring member. This can make the blade excellent in strength balance while reducing its weight. Therefore, it is possible to arrange the cooling fan even at a location where an external force such as a water hammer is likely to be applied when the automobile is moving, to thereby improve in-vehicle layout capability.

DESCRIPTION OF THE REFERENCE SYMBOLS

1: COOLING FAN
2: BOSS PORTION
3: BLADE
3*a*: BASE PORTION
3*b*: TIP PORTION
20: RING MEMBER

BEST MODE FOR CARRYING OUT THE INVENTION

Next is a description of an embodiment of this invention based on the drawings.

Figure 1:
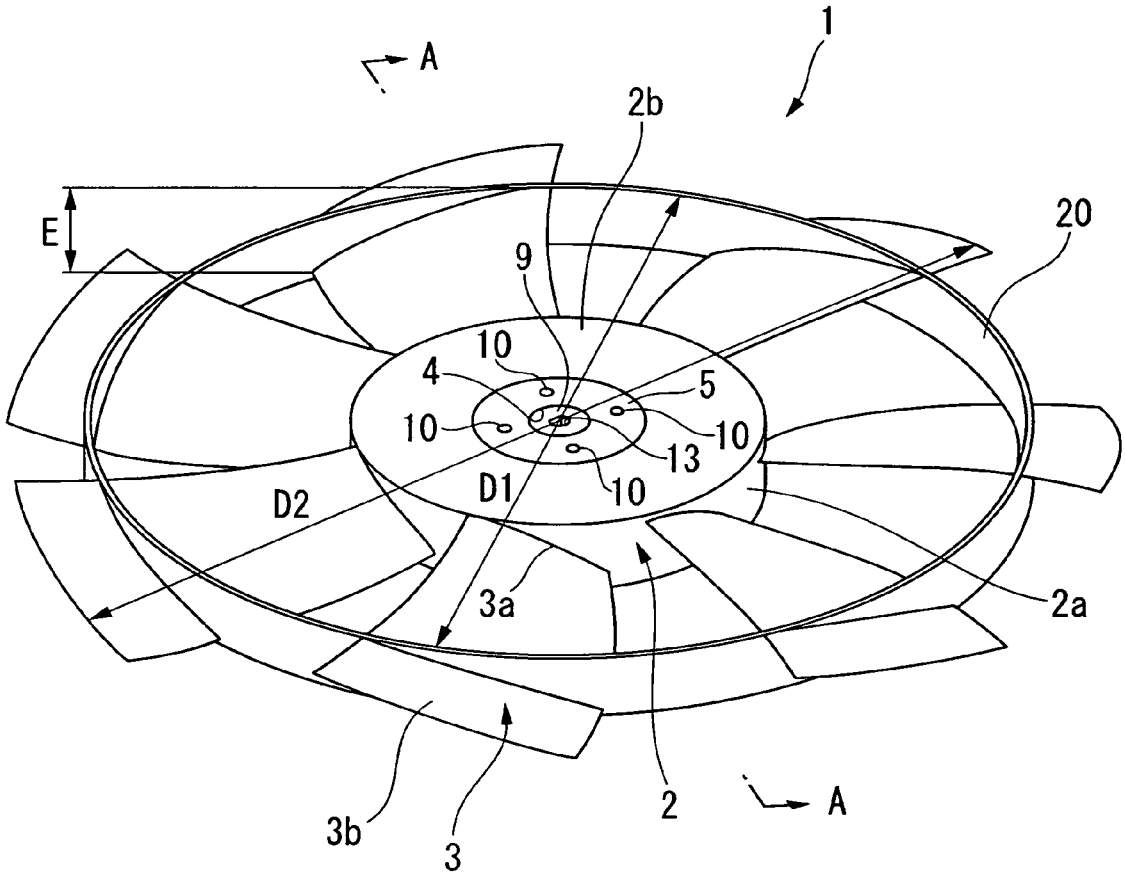
FIG. 1 is a perspective view showing a cooling fan according to an embodiment of the present invention.
Figure 2:
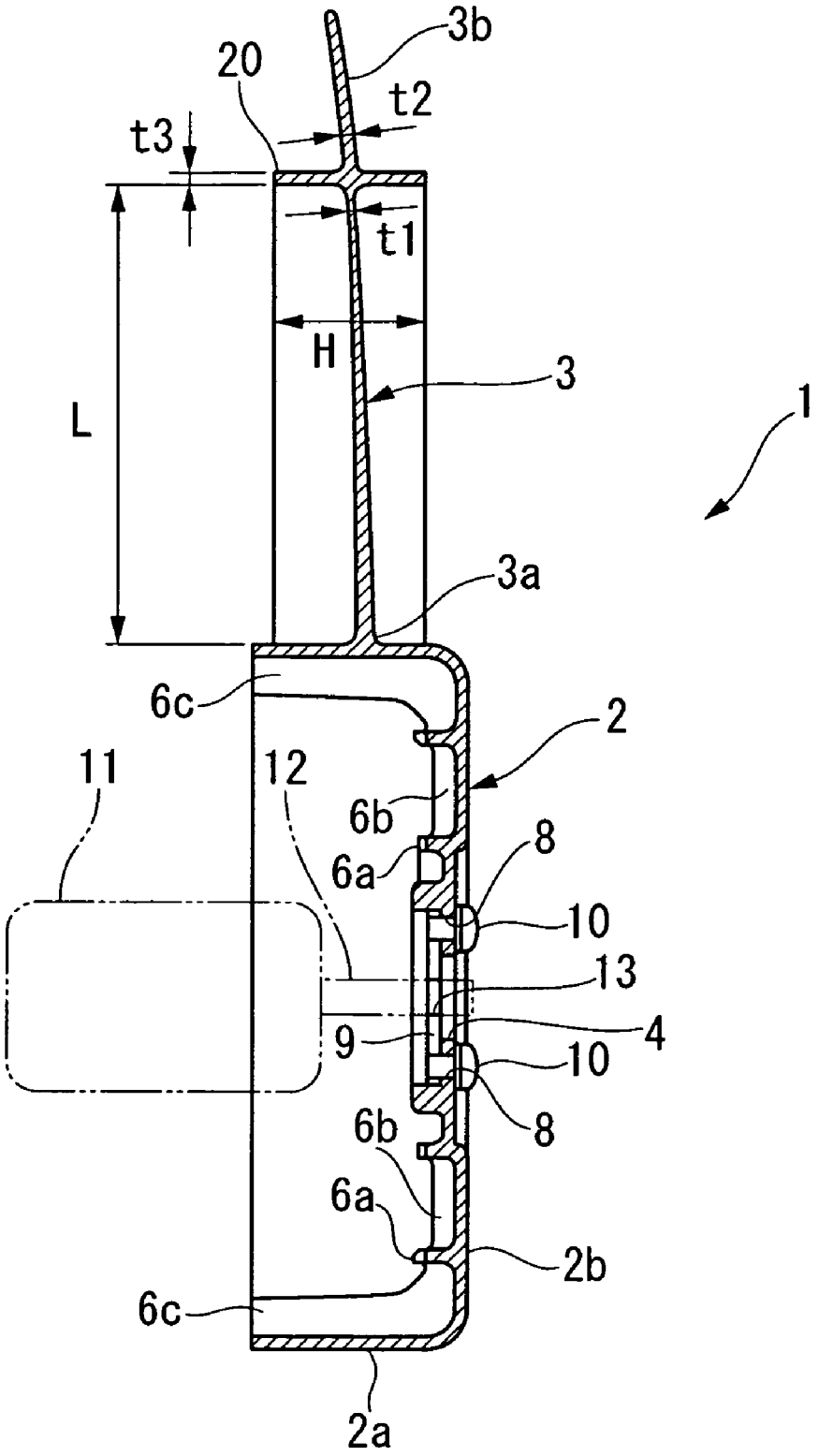
FIG. 2 is a cross-sectional view of FIG. 1 taken along the A-A line.
Figure 3:
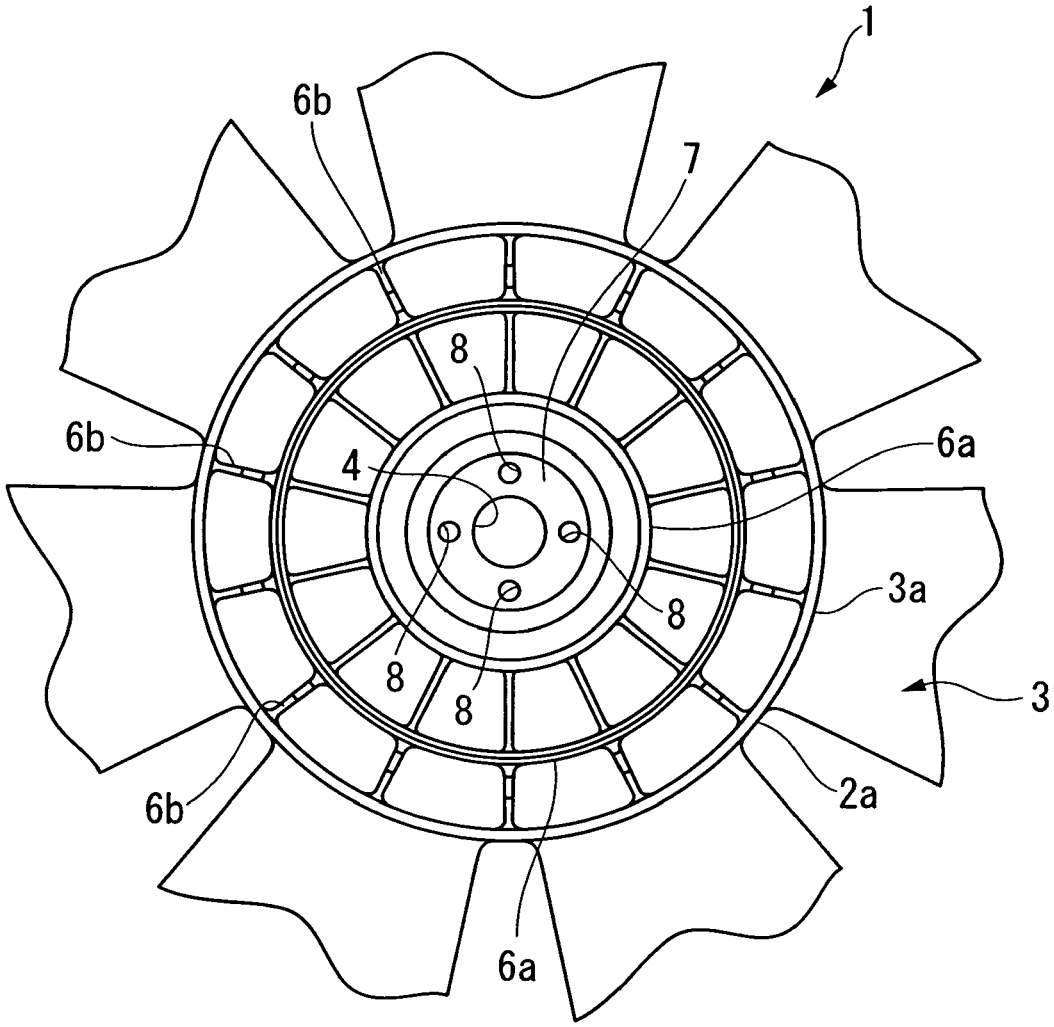
FIG. 3 is a plan view of the cooling fan according to the embodiment of the present invention.

As shown in FIG. 1 to FIG. 3, a cooling fan 1 for an automobile radiator is an axial fan, including: a bottomed cylindrical boss portion 2 attached on a rotation shaft 12 of an electric motor 11; a plurality of (seven, in this embodiment) blades 3 provided on an outer circumferential surface of the boss portion 2, the blades 3 radiating in a radial direction, in which a cylindrical ring member 20 for connecting the blades 3 with each other is provided on a side radially inner from tips of the blades 3.

The boss portion 2 is made of: a circumferential wall 2*a*; and a bottom wall 2*b*.A coupling portion between the circumferential wall 2*a* and the bottom wall 2*b*, that is, an intersection ridgeline between the circumferential wall 2*a* and the bottom wall 2*b* is formed into an arc shape (a circular chamfered shape). At a radial center of the bottom wall 2*b*, there is formed a through-hole 4 through which the rotation shaft 12 of the electric motor 11 penetrates. In an outer surface of the bottom wall 2*b*, there is formed a recessed portion 5 around the through-hole 4, the recessed portion 5 being substantially circular when seen in a planar view.

On the bottom wall 2*b* of the boss portion 2, there are provided two reinforcing ribs 6*a* on an internal surface side thereof in a coaxial manner. In addition, to the bottom wall 2*b*, there are connected a plurality of reinforcing ribs 6*b* radiating in the radial direction. Furthermore, on an inner circumferential surface of the circumferential wall 2*a*, there are provided reinforcing ribs 6*c*. Each of the reinforcing ribs 6*c* are formed so as to continue into each of the reinforcing ribs 6*b* provided on the bottom wall 2*b*.

On the internal surface side of the bottom wall 2*b*, there is provided a plate container recessed portion 7 at the radial center. In the plate container recessed portion 7, there are formed four bolt holes 8 in an evenly spaced manner in the circumferential direction. On the plate container recessed portion 7, a fan plate 9 that engages the rotation shaft 12 of the electric motor 11 is fastened and fixed by bolts 10. At the radial center of the fan plate 9, there is formed an attachment hole 13 whose shape corresponds to the cross-sectional shape of the rotation shaft 12.

With the engagement of the attachment hole 13 with the rotation shaft 12, the rotation shaft 12 co-rotates with the fan plate 9 (the boss portion 2). In this embodiment, the rotation shaft 12 and the attachment hole 13 are formed in a D shape when seen in a planar view. However, the shapes of the rotation shaft 12 and the attachment hole 13 are not limited to this. Any shape is permissible so long as it allows both to co-rotate.

The blades 3 provided on the circumferential wall 2*a* of the boss portion 2 are forward swept wings. They are integrally formed with the boss portion 2 so as to have an arched shape toward the rotation direction. In the blade 3, an angle of attack of the base portion 3*a* is set large, and a chord length is set short. In addition, the angle of attack is set smaller and the chord length is set longer as the position is closer to the tip of the blade 3.

As shown in FIG. 2, the thickness of the blade 3 is formed thinner than that of a conventional blade without a ring member 20. It is formed so as to be gradually thinner from the base portion 3*a*, which has substantially the same thickness as that of the conventional blade, to the ring member 20. On the other hand, the thickness of the tip portion 3*b* of the blade 3 positioned radially outer from the ring member 20 is set substantially equal to that of the base portion 3*a*.

That is, a thickness t1 of the blade 3 positioned radially inner from the ring member 20 and also in the vicinity of the ring member 20 is set thinner than the conventional one, and is also set thinner than a thickness t2 of the blade 3 positioned radially outer from the ring member 20. Note that a thickness t3 of the ring member 20 is set substantially equal to the thickness t2 of the tip portion 3*b* of the blade 3.

As shown in FIG. 1 and FIG. 2, a length H in the axial direction of the ring member 20 is set so as to correspond to (substantially coincide with, in this embodiment) a width E in the axial direction of the portion of the blade 3 on which the ring member 20 is provided. That is, the length H in the axial direction of the ring member 20 varies corresponding to a diameter D1 of the ring member 20 (the portion of the blade 3 on which the ring member 20 is provided).

It is desirable that the diameter D1 of the ring member 20 be set such that the ring member 20 is positioned on the side inner from the tips of the blades 3 and is also positioned on the side outer from the radial centers of the blades 3. To be more specific, for example, if a fan diameter D2 of the cooling fan 1 is ϕ340 mm, it is desirable that the diameter D1 of the ring member 20 be approximately ϕ280 mm. With such a setting, it is possible to make the blade 3 thinner while effectively securing the strength of the blade 3.

Therefore, according to the aforementioned embodiment, the cylindrical ring member 20 that connects the blades 3 with each other is provided on the side radially inner from the tips of the blades 3. This can make the fan diameter D2 of the cooling fan 1 equal to a cooling fan of a type without a ring member 20. As a result, the necessity to fabricate a fan shroud dedicated to the cooling fan 1 is eliminated. This can enhance the versatility of the cooling fan 1.

Here, a fan shroud refers to a duct for ventilation, which is attached in order to enhance efficiency of a cooling fan. It is a part in the shape of a wind channel arranged between the automobile radiator and the cooling fan 1. In general, the fan shroud is often fabricated from a resin.

Furthermore, according to the aforementioned embodiment, it is possible to make the diameter D1 of the ring member 20 smaller than that of a conventional fan with a ring member 20 provided on tips of blades 3. Therefore, it is possible to reduce manufacturing costs of the cooling fan 1 provided with the ring member 20.

In addition, it is possible to make a distance L from the base portion 3*a* of the blade 3 to the ring member 20 (see FIG. 2) shorter than that in the case where the ring member 20 is provided on the tips of the blades 3. This makes it possible to secure the strength of the blade 3 even if the blade 3 is formed so as to be thinner from the base portion 3*a* to the ring member 20. As a result, it is possible to suppress the flapping of the blades 3 when the cooling fan 1 is rotated. Therefore, it is possible to prevent the worsening of the noise characteristic while reducing the weight of the blade 3.

Figure 4:
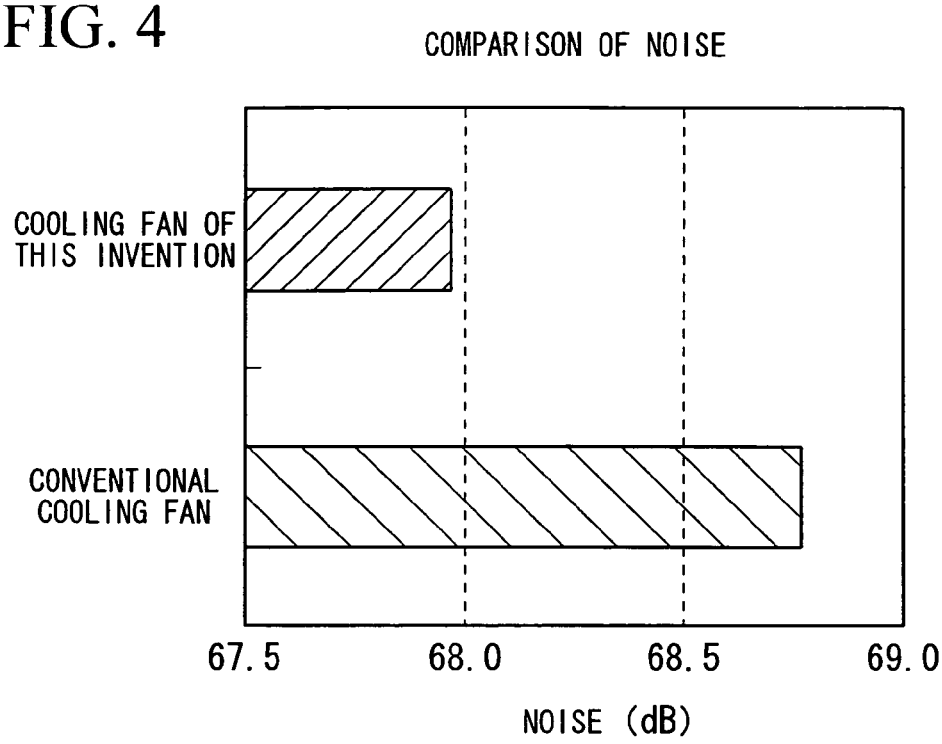
FIG. 4 is a graph showing the noise characteristic of the cooling fan according to the embodiment of the present invention.

FIG. 4 is a graph showing a comparison of the noise characteristic between the cooling fan 1 of this embodiment and a conventional cooling fan. As shown in the figure, the fact is verified that the noise of the cooling fan 1 is less than that of the conventional cooling fan by about 10 percent.

Furthermore, according to the aforementioned embodiment, the blade 3 on the side radially inner from the ring member 20 is supported by the boss portion 2 and the ring member 20. On the other hand, the blade 3 on the side radially outer from the ring member 20 is supported only by the ring member 20. Therefore, the blade 3 on the side radially inner from the ring member 20 is stronger than the blade 3 (the tip portion 3*b*) on the radially outer side of the ring member 20.

Consequently, it is possible to set the thickness of the blade 3 on the side radially inner from the ring member 20 thinner than that of the tip portion 3*b* of the blade 3. This can make the blade 3 excellent in strength balance while reducing weight. Therefore, it is possible to arrange the cooling fan 1 even at a location where an external force such as a water hammer is likely to be applied when the automobile is moving, to thereby improve in-vehicle layout capability.

Figure 5:
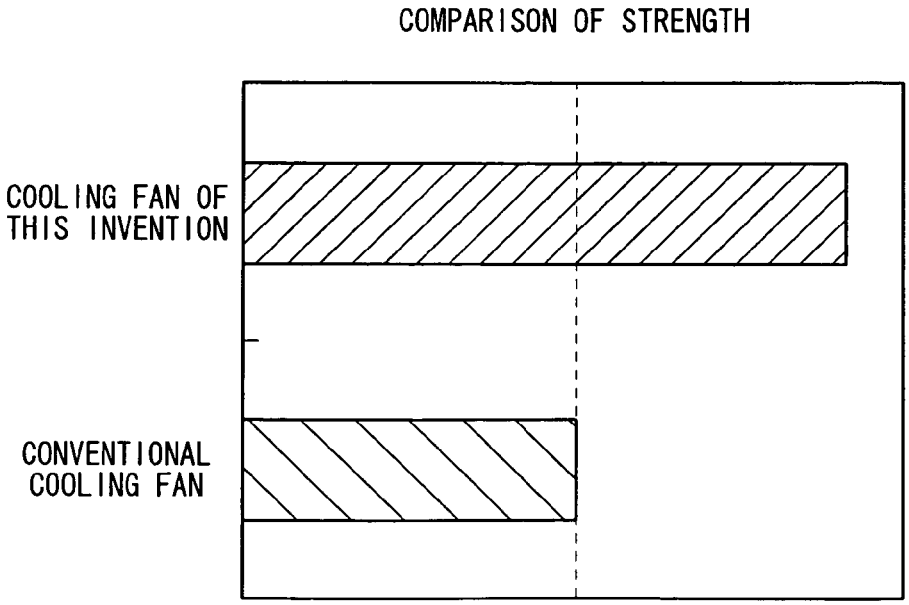
FIG. 5 is a graph showing the strength of the cooling fan according to the embodiment of the present invention.

FIG. 5 is a graph showing a comparison of a strength between the cooling fan 1 of this embodiment and a conventional cooling fan. As shown in the figure, the fact is verified that the cooling fan 1 has a strength about twice as much as that of the conventional cooling fan.

Furthermore, according to the aforementioned embodiment, it is possible to secure the strength of the blade 3 by means of the ring member 20. Therefore, it is possible to make the diameter of the boss portion 2 smaller, and to increase its fan volume as much. Therefore, it is possible to downsize the cooling fan 1.

The present invention is not limited to the aforementioned embodiment and includes ones in which various modifications are made to the aforementioned embodiment without departing from the spirit or scope of the present invention.

Furthermore, in the aforementioned embodiment, the description has been for the case where the cooling fan 1 is an axial fan. However, the cooling fan 1 may be a diagonal fan.

In addition, in the aforementioned embodiment, the description has been for the case where the cooling fan 1 is used for an automobile radiator. However, the application is not limited to this.

Furthermore, in the aforementioned embodiment, the description has been for the case where the thickness t1 of the blade 3 positioned radially inner from the ring member 20 is set thinner than that of the conventional one, and also thinner than the thickness t2 of the blade 3 positioned radially outer from the ring member 20. However, the construction is not limited to this. The thickness t2 of the blade 3 positioned radially outer from the ring member 20 may be set thinner than that of the conventional one, and be also thinner than the thickness t1 of the blade 3 positioned radially inner from the ring member 20.

Even in the case with such a construction, it is possible to reduce weight compared with the case of the conventional cooling fan because the thickness t2 of the blade 3 positioned radially outer from the ring member 20 is made thinner. Furthermore, if the thickness t1 of the blade 3 positioned radially inner from the ring member 20 is made substantially equal to that of the conventional one while the ring member 20 is provided on the side radially inner from the tips of the blades 3, it is possible to improve the strength compared with the case of the conventional cooling fan.

Industrial Applicability

According to the present invention, it is possible to provide a cooling fan capable of preventing the worsening of the noise characteristic and also of enhancing the versatility even if the blades are made thinner.

The invention claimed is:

1. A cooling fan, comprising:

a bottomed cylindrical boss portion; and a plurality of blades provided on an outer circumferential surface of the boss portion, the blades radiating in a radial direction, wherein a ring member for connecting the blades with each other is provided on a side radially inner from tips of the blades, each of the blades has a pair of surfaces configured as both faces of the blade between the boss portion and the ring member, and a cross section of each of the surfaces along a radial direction of the boss portion is formed as a substantial straight line, and each of the blades is formed so that a width between the pair of surfaces is gradually narrower from a base portion on the boss portion side of the blades to the ring member.

2. The cooling fan according to claim 1, wherein the ring member is provided on a side outer from radial centers of the blades.

3. The cooling fan according to claim 1, wherein a thickness of the blade positioned radially inner from the ring member is set different from a thickness of the blade positioned radially outer from the ring member.

4. The cooling fan according to claim 2, wherein a thickness of the blade positioned radially inner from the ring member is set different from a thickness of the blade positioned radially outer from the ring member.

5. The cooling fan according to claim 3, wherein the thickness of the blade positioned radially inner from the ring member is set thinner than the thickness of the blade positioned radially outer from the ring member.

6. The tooling fan according to claim 4, wherein the thickness of the blade positioned radially inner from the ring member is set thinner than the thickness of the blade positioned radially outer from the ring member.

* * * * *